US011125045B2

(12) United States Patent
Hern et al.

(10) Patent No.: US 11,125,045 B2
(45) **Date of Patent: *Sep. 21, 2021**

(54) FRAC PLUG SYSTEM WITH INTEGRATED SETTING TOOL

(71) Applicants: Gregory Hern, Porter, TX (US); YingQing Xu, Houston, TX (US); Juan Carlos Flores Perez, The Woodlands, TX (US)

(72) Inventors: Gregory Hern, Porter, TX (US); YingQing Xu, Houston, TX (US); Juan Carlos Flores Perez, The Woodlands, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/878,286

(22) Filed: May 19, 2020

(65) Prior Publication Data

US 2020/0277837 A1 Sep. 3, 2020

Related U.S. Application Data

(63) Continuation-in-part of application No. 16/195,263, filed on Nov. 9, 2018, now Pat. No. 10,808,492.

(51) Int. Cl.

| | |
|---|---|
| ***E21B 33/128*** | (2006.01) |
| ***E21B 33/129*** | (2006.01) |
| ***E21B 23/04*** | (2006.01) |
| ***E21B 33/1295*** | (2006.01) |

(52) U.S. Cl.
CPC ..... *E21B 33/128* (2013.01); *E21B 23/0412* (2020.05); *E21B 23/0417* (2020.05); *E21B 33/1293* (2013.01); *E21B 33/1295* (2013.01)

(58) Field of Classification Search
CPC ..... E21B 33/1285; E21B 23/01; E21B 23/04; E21B 33/129; E21B 23/065; E21B 33/12; E21B 33/128; E21B 43/26; E21B 43/16
See application file for complete search history.

(56) References Cited

U.S. PATENT DOCUMENTS

| | | | |
|---|---|---|---|
| 2,707,998 | A | 5/1955 | Baker et al. |
| 2,807,325 | A | 9/1957 | Webb |
| 3,024,843 | A | 3/1962 | Dean |
| 3,977,473 | A | 8/1976 | Page |
| 5,024,270 | A | 6/1991 | Bostick |
| 7,017,672 | B2 | 3/2006 | Owen, Sr. et al. |
| 9,010,416 | B2 | 4/2015 | Xu et al. |

(Continued)

OTHER PUBLICATIONS

U.S. Appl. No. 16/195,263, filed Nov. 2018, Hern, Gregory.*

(Continued)

*Primary Examiner* — Taras P Bemko
*Assistant Examiner* — Manuel C Portocarrero
(74) *Attorney, Agent, or Firm* — Cantor Colburn LLP

(57) ABSTRACT

A frac plug system downhole tool and method of securing a frac plug system in a wellbore. A mandrel extending from a first end to a second end. A setting assembly is on the first end of the mandrel and is movable along the mandrel. An anchor is at the second end of the mandrel and is expandable to engage the wellbore. A gas generates a pressure to move the setting assembly along the mandrel to expand the anchor at the second end of the mandrel.

21 Claims, 10 Drawing Sheets

(56) References Cited

U.S. PATENT DOCUMENTS

| | | | | |
|---|---|---|---|---|
| 9,033,060 | B2 | 5/2015 | Xu et al. | |
| 9,057,260 | B2 | 6/2015 | Kelbie et al. | |
| 9,080,416 | B2 | 7/2015 | Xu et al. | |
| 9,080,439 | B2 | 7/2015 | O'Malley et al. | |
| 9,528,342 | B2 * | 12/2016 | Xu | E21B 33/1293 |
| 9,810,035 | B1 | 11/2017 | Carr et al. | |
| 9,816,339 | B2 | 11/2017 | Xu | |
| 9,976,381 | B2 | 5/2018 | Martin et al. | |
| 10,443,331 | B1 * | 10/2019 | Andres | E21B 33/1293 |
| 10,808,492 | B2 * | 10/2020 | Hern | E21B 23/065 |
| 2004/0216868 | A1 | 11/2004 | Owen, Sr. | |
| 2005/0230100 | A1 | 10/2005 | Hirth et al. | |
| 2010/0230116 | A1 | 9/2010 | Harmon et al. | |
| 2013/0186649 | A1 | 7/2013 | Xu et al. | |
| 2014/0041857 | A1 | 2/2014 | Xu et al. | |
| 2014/0190685 | A1 | 7/2014 | Frazier et al. | |
| 2015/0129203 | A1 | 5/2015 | Deutch et al. | |
| 2016/0290093 | A1 | 10/2016 | Doane et al. | |
| 2016/0312555 | A1 | 10/2016 | Xu et al. | |
| 2017/0022781 | A1 | 1/2017 | Martin et al. | |
| 2017/0130553 | A1 | 5/2017 | Harris et al. | |
| 2017/0234108 | A1 * | 8/2017 | Xu | E21B 33/129 166/373 |
| 2018/0016859 | A1 | 1/2018 | Stair et al. | |
| 2018/0051532 | A1 | 2/2018 | Smith et al. | |
| 2020/0157900 | A1 | 5/2020 | Hern et al. | |
| 2020/0157913 | A1 | 5/2020 | Hern | |
| 2020/0157915 | A1 | 5/2020 | Hern et al. | |

OTHER PUBLICATIONS

International Search Report and Written Opinion for Intnerional Application No. PCT/US2019/061806; International Filing Date Nov. 15, 2019; dated Mar. 11, 2020 (pp. 1-10).

International Search Report and Written Opinion for Intnerional Application No. PCT/US201/061911; International Filing Date Nov. 18, 2019; dated Mar. 12, 2020 (pp. 1-11).

International Search Report and Written Opinion for Intnerional Application No. PCT/US2019/061914; International Filing Date Nov. 18, 2019; dated Mar. 16, 2020 (pp. 1-11).

* cited by examiner

FRAC PLUG SYSTEM WITH INTEGRATED SETTING TOOL

CROSS REFERENCE TO RELATED APPLICATIONS

This application is a continuation-in-part and claims priority to U.S. patent application Ser. No. 16/195,263, filed Nov. 19, 2018, the contents of which are incorporated herein in their entirety.

BACKGROUND

In the resource recovery industry, boreholes are formed to test for and recover formation fluids. During testing and extraction, various tools are deployed into the borehole. A frac plug may be set against a casing and used as part of a process that initiates a fracture in a formation. Setting a frac plug, or other seal may require the use of drop balls, explosive charges or other tools that increase an overall cost and complexity of operation.

Typically, a force, initiated by the explosive charge, may urge a setting member into a seal. After the frac plug is set, guns are fired to perforate the casing. Pressure may then be applied to a drop ball after the tool is removed to fracture the formation. Plugging and perforating the casing and fracturing the formation includes multiple steps. Accordingly, the art would be receptive of alternative methods for setting seals downhole.

SUMMARY

In one embodiment, disclosed herein is a method of securing a frac plug system in a wellbore. The method includes disposing the frac plug system in the wellbore, the frac plug system including: a mandrel extending from a first end to a second end, a setting assembly at a first end of the mandrel, wherein the setting assembly is movable along the mandrel, and an anchor at a second end of the mandrel, the anchor expandable to engage the wellbore; and generating a pressure in a gas of the frac plug system to move the setting assembly from the first end to the second end to expand the anchor at the second end of the mandrel.

In another embodiment, disclosed herein is a downhole tool. The downhole tool includes a mandrel extending from a first end to a second end, a setting assembly on the first end of the mandrel, the setting assembly movable along the mandrel, an anchor at the second end of the mandrel, the anchor expandable to engage the wellbore, and a gas for moving the setting assembly along the mandrel to expand the anchor at the second end of the mandrel.

In yet another embodiment, disclosed herein is a frac plug system. The frac plug system includes a mandrel extending from a first end to a second end, a setting assembly on the first end of the mandrel, an anchor at the second end of the mandrel, the anchor expandable to engage the wellbore, and a gas for moving the setting assembly along the mandrel to expand the anchor at the second end of the mandrel.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
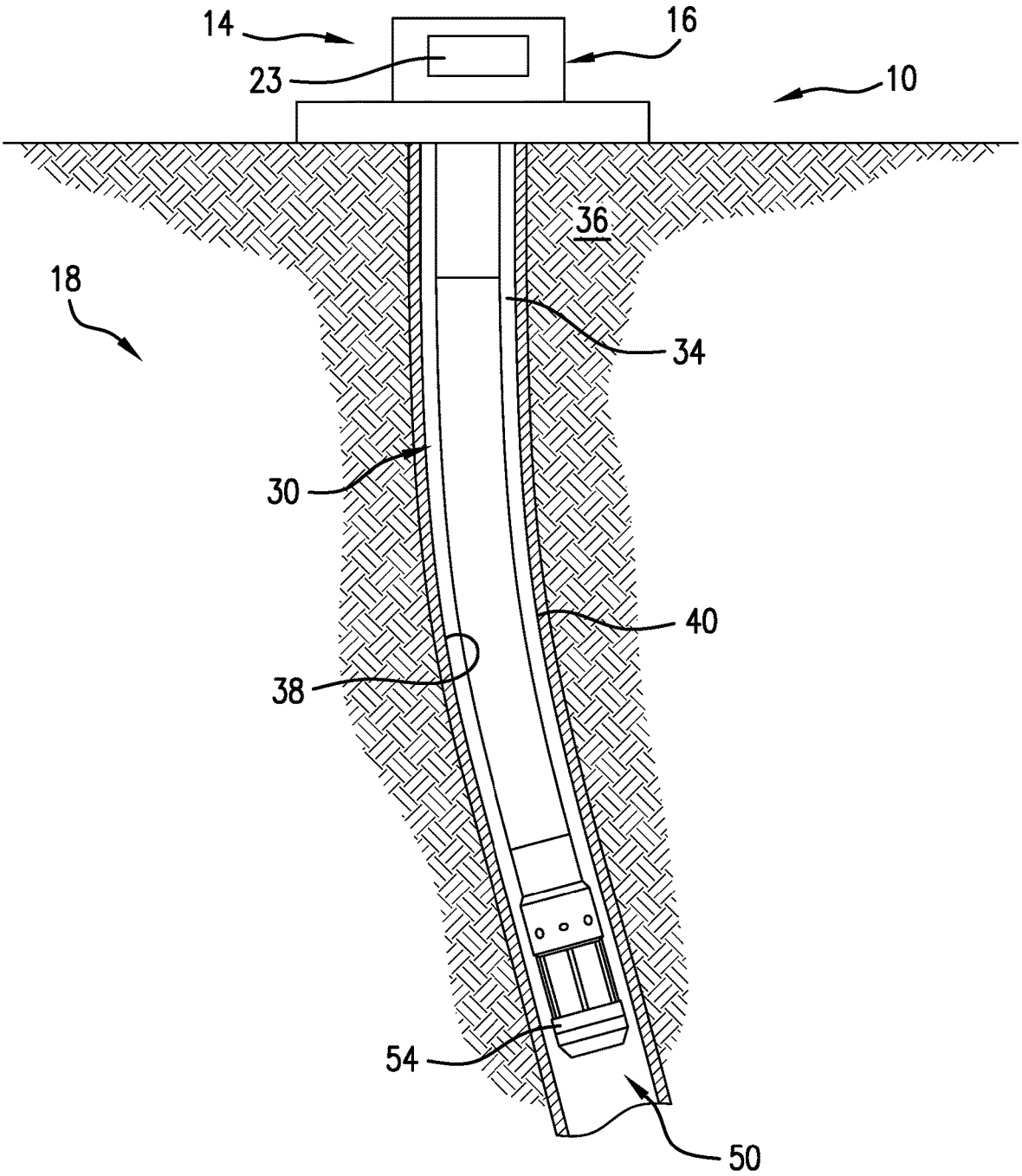
FIG. 1 depicts a resource exploration and recovery system including a frac plug system having an integrated setting tool, in accordance with an aspect of an exemplary embodiment.

A resource exploration and recovery system, in accordance with an exemplary embodiment, is indicated generally at 10, in FIG. 1. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a subterranean system.

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include tubular string or wireline 30 that extends into a wellbore 34 formed in formation 36. Wireline 30 may be operatively connected to control system 23. Wellbore 34 includes an annular wall 38 which may be defined by a surface of formation 36, or a casing tubular 40 such as shown.

Figure 2:
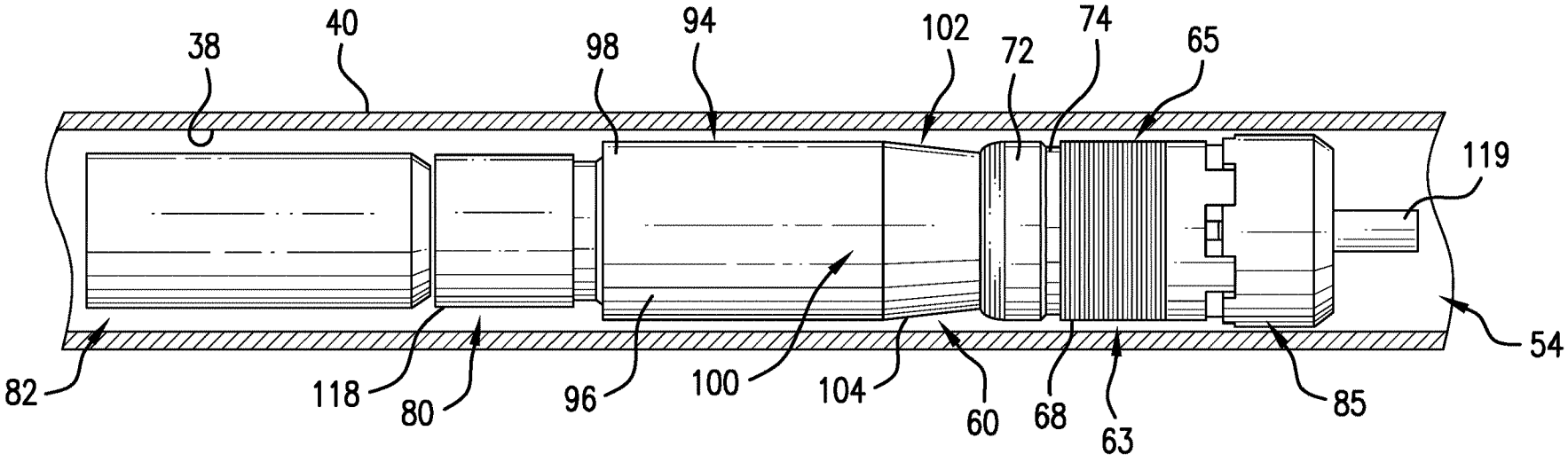
FIG. 2 depicts the frag plug system of FIG. 1, in accordance with an aspect of an exemplary embodiment.

In an exemplary aspect, wireline 30 supports a downhole tool 50. As will be detailed herein, downhole tool 50 may take the form of a frac plug system 54 that may be selectively engaged with annular wall 38. Referring to FIG. 2, the frac plug system 54 includes a setting cone 60 that may force an anchor 63 into engagement with annular wall 38. Anchor 63 may take the form of a slip 65 having a plurality of wickers 68. Wickers 68 "bite" into annular surface or annular wall 38 when slip 65 moves along setting cone 60. Setting cone 60 also supports a seal 72 and a backup ring 74. Backup ring 74 urges seal 72 along setting cone 60. Seal 72 may seal against annular wall 38.

A mandrel 80 extends through setting cone 60 and supports an actuator head 82. Mandrel 80 also extends through an end cap 85. As will be detailed herein, actuator head 82 establishes a force that drives mandrel 80 axially relative to setting cone 60. End cap 85 drives slip 65 along setting cone 60 forcing wickers 68 and seal 72 into contact with annular wall 38.

Figure 3:
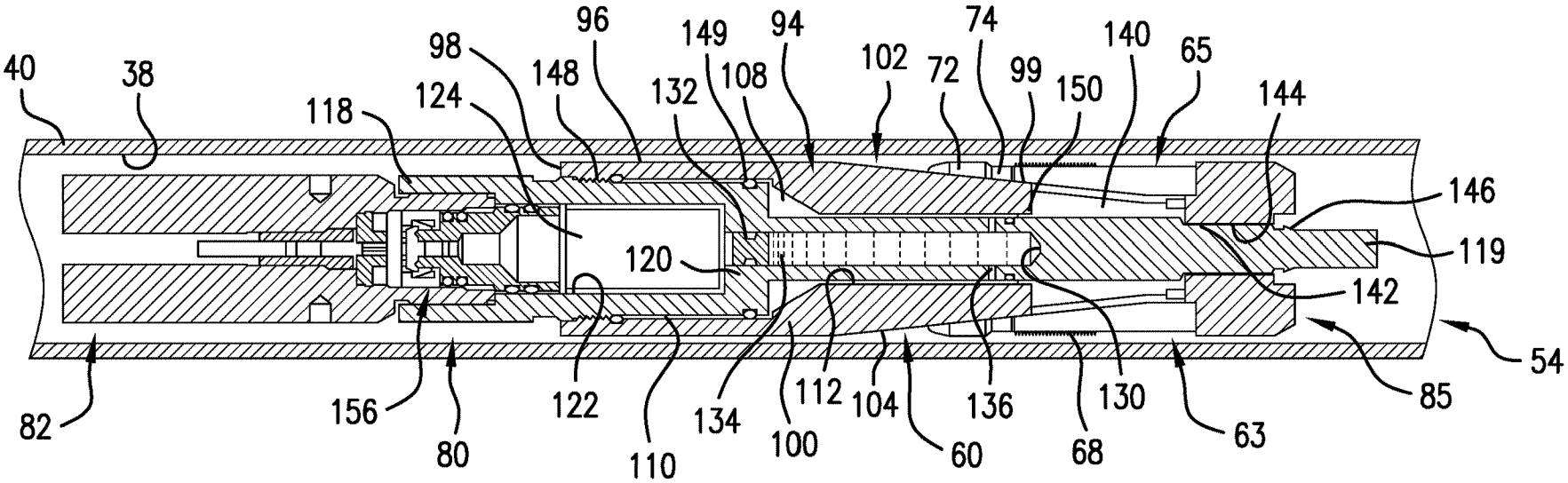
FIG. 3 depicts a cross-sectional view of the frac plug of FIG. 2, in accordance with an aspect of an exemplary embodiment.

Reference will now follow to FIG. 3, with continued reference to FIGS. 1 and 2 in describing the frac plug system 54. Setting cone 60 includes a body 94 having an outer surface 96 including a first end 98, a second end 99, and an intermediate portion 100. A portion of body 94 includes a taper 102. In an embodiment, taper 102 defines a frusto-conical surface 104 that extends from second end 99 toward first end 98. A passage 108 extends through body 94. Passage 108 includes a first portion 110 having a first diameter and a second portion 112 having a second diameter that is smaller than the first diameter. Mandrel 80 extends through passage 108.

Mandrel 80 includes a first end portion 118, second end portion 119, and an intermediate section 120 extending therebetween. A conduit 122 extends through mandrel 80. A first portion (not separately labeled) of conduit 122 defines an activation chamber 124 that, in the embodiment shown, is arranged in first portion 110 of passage 108. Activation chamber 124 may take the form of a power charge chamber (not separately labeled) housing an amount of propellant which, when ignited, produces high pressure gases. Activation chamber 124 may, in the alternative, house an atmospheric fluid, e.g., a fluid, such as air, at atmospheric pressure. Conduit 122 terminates at a blind end 130 within mandrel 80. A piston 132 is arranged in conduit 122 between activation chamber 124 and blind end 130.

An amount of fluid 134 is disposed between piston 132 and blind end 130. The amount of fluid may take on many forms including hydraulic fluid, aqueous solutions, gas and the like. One or more openings 136 are arranged in conduit 122 between piston 132 and blind end 130. Openings 136 as sized so as to allow passage of fluid 134 upon movement of piston 132 toward blind end 130. Second end portion 119 extends through a central opening 140 provided in anchor 63 and a passage portion 142 provided in end cap 85. In one embodiment, second end portion 119 may be connected to end cap 85 through frangible threads 144. Second end portion 119 may include a stop member or travel limiter 146 that prevents end cap from pre-maturely disengaging from mandrel 80 during, for example, run in. Travel limiter 146 may take the form of an O-ring (not separately labeled).

A thread 148 provides a connection between setting cone 60 and mandrel 80 during a run-in operation. A first seal 149 is arranged between first end portion 118 and first portion 110 of passage 108. A second seal 150 extends about intermediate section 120 axially outwardly of openings 136 toward second end portion 119.

In an embodiment, frac plug system 54 may be run into wellbore 34 on wireline 30 to a desired position. Once in position, a signal may be sent to actuator head 82 from first system 14 to activate an actuator mechanism 156 arranged in first end portion 118 adjacent to activation chamber 124. In an embodiment, actuator mechanism 156 ignites a power charge arranged in actuator chamber 124 creating a flow of high pressure gasses. In another embodiment, actuator mechanism 156 allows hydrostatic pressure to enter activation chamber 124 creating a pressure differential with the atmospheric fluid. The flow of high pressure gases (or pressure differential between the hydrostatic fluid and the atmospheric fluid) act on piston 132 driving fluid 134 through openings 136. Fluid 134 flows toward first end portion 118. Movement of setting cone 60 causes threads 148 holding mandrel 80 in place to shear. Shearing the threads relative movement between setting cone 60 and mandrel 80 is now possible. At this point, it should be understood that in lieu of threads, mandrel 80 may be connected to setting cone 60 through shear screws (not shown). At this point, pressure induced by fluid 134 causes mandrel 80 to move axially relative to setting cone 60.

Figure 4:
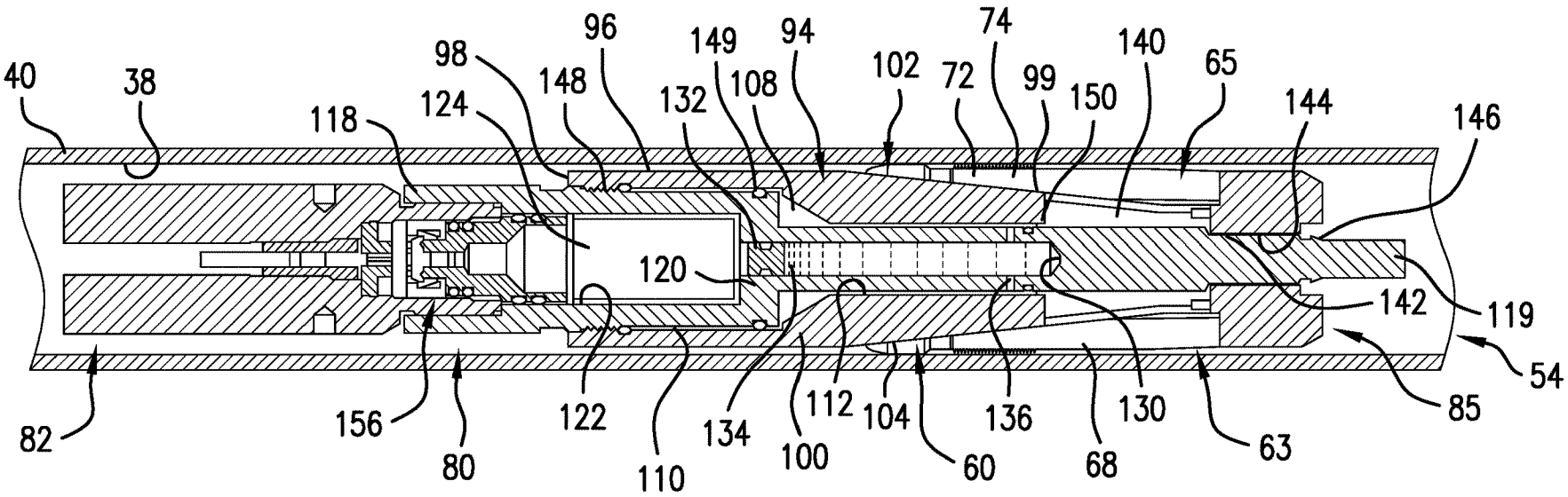
FIG. 4 depicts the frac plug of FIG. 3 being deployed such that an anchor and seal engage a casing wall, in accordance with an aspect of an exemplary embodiment.
Figure 5:
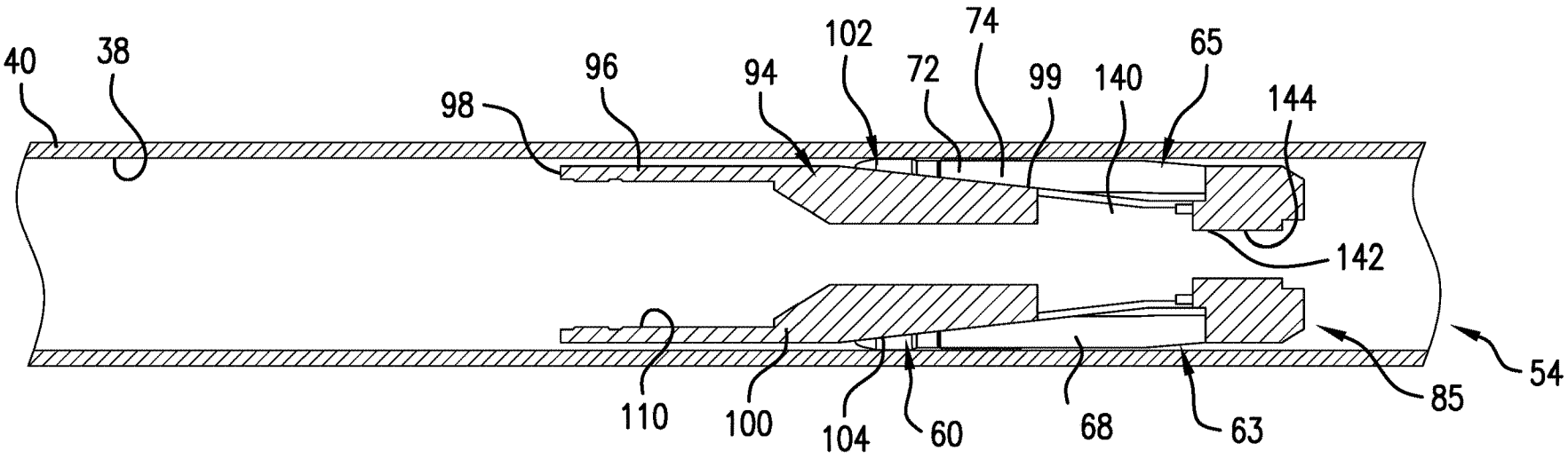
FIG. 5 depicts the frac plug of FIG. 4 after deployment.

Movement of end cap 85 is constrained causing anchor 63, backup ring 74 and seal 72 to move along frusto-conical surface 104. Anchor 63 moves along frusto-conical surface 104 until wickers 68 engage annular wall 38 preventing further movement as shown in FIG. 4. Seal 72 also engages annular wall 38. After anchor 63 is set, wireline 30 may be pulled upwardly toward first system 14 disengaging mandrel 80 from setting cone 60 as shown in FIG. 5. At this point, a signal may be sent to perforating guns (not shown) from first system 14 to activate explosive charges that create openings in casing tubular 40. At this point, a plug (not shown) may be introduced into frac plug system 54 to fluidically isolate part of wellbore 34 from another. Surface system 16 may pump a fluid into wellbore 34 to initiate a fracturing operation. In an embodiment, setting cone 60, seal 72, backup ring 74 anchor 63 and end cap 85 may be formed from a dissolvable material. In this manner, frac plug system 54 may be removed after setting without the need for a milling operation or other procedure that requires additional trips into wellbore 34.

Figure 6:
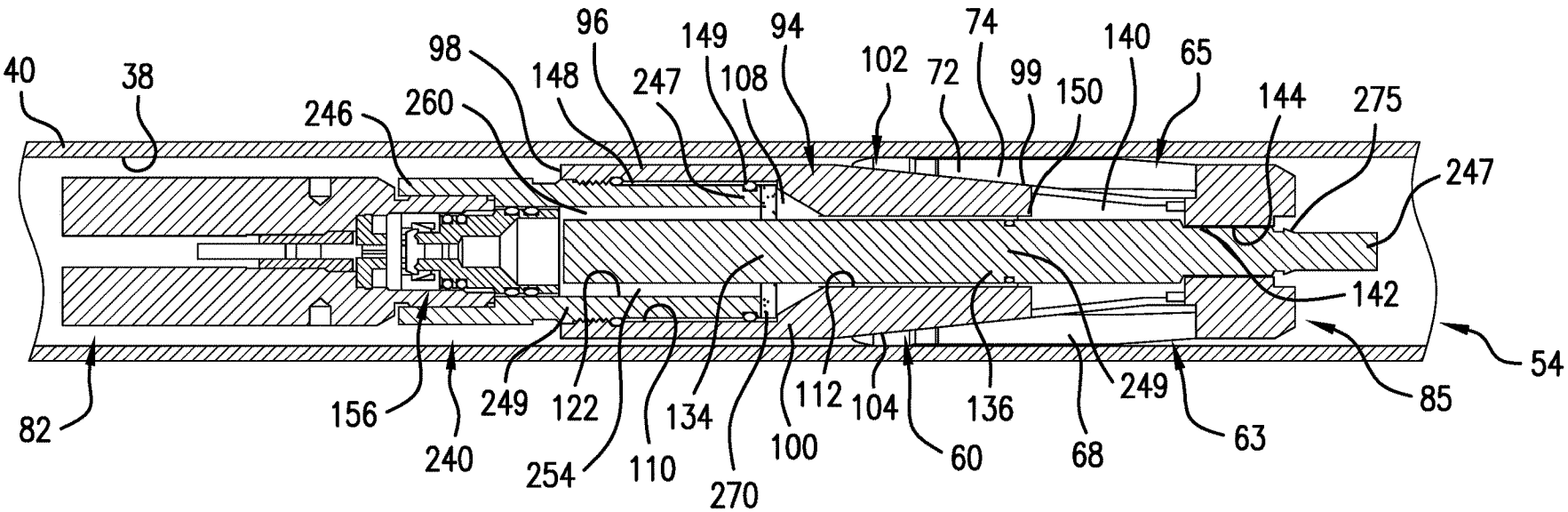
FIG. 6 depicts the frac plug of FIG. 1, in accordance with another aspect of an exemplary embodiment.

Reference will now follow to FIG. 6, wherein like reference numbers represent corresponding parts in the respective views, in describing a mandrel 240 in accordance with another aspect of an exemplary embodiment. Mandrel 240 extends through setting cone 60 and supports actuator head 82. Mandrel 240 also extends through an end cap 85. In the embodiment shown, mandrel 240 includes a first end portion 246, second end portion 247, and an intermediate section 249 extending therebetween. A conduit 254 extends through mandrel 240. A first portion (not separately labeled) of conduit 254 defines an activation chamber 260. Activation chamber 260 provides a pathway that connects actuator head 82 and a power charge 270.

In the embodiment shown, power charge 270 is arranged in passage 108 and extends around intermediate section 249 of mandrel 240. In a manner similar to that discussed herein, second end portion 247 may include a stop member or travel limiter 275 that prevents end cap from pre-maturely disengaging from mandrel 240 during, for example, run in. Travel limiter 275 may take the form of an O-ring (not separately labeled).

Once the frac plug system 54 is in position, a signal may be sent to actuator head 82 from first system 14. Actuator head 82 than sends a signal to ignite power charge 270 creating a flow of high pressure gasses. The flow of high pressure act between setting cone 60 and mandrel 240, in this manner, relative movement between setting cone 60 and mandrel 240 may be affected causing a radial outward expansion of anchor 63.

Figure 7:
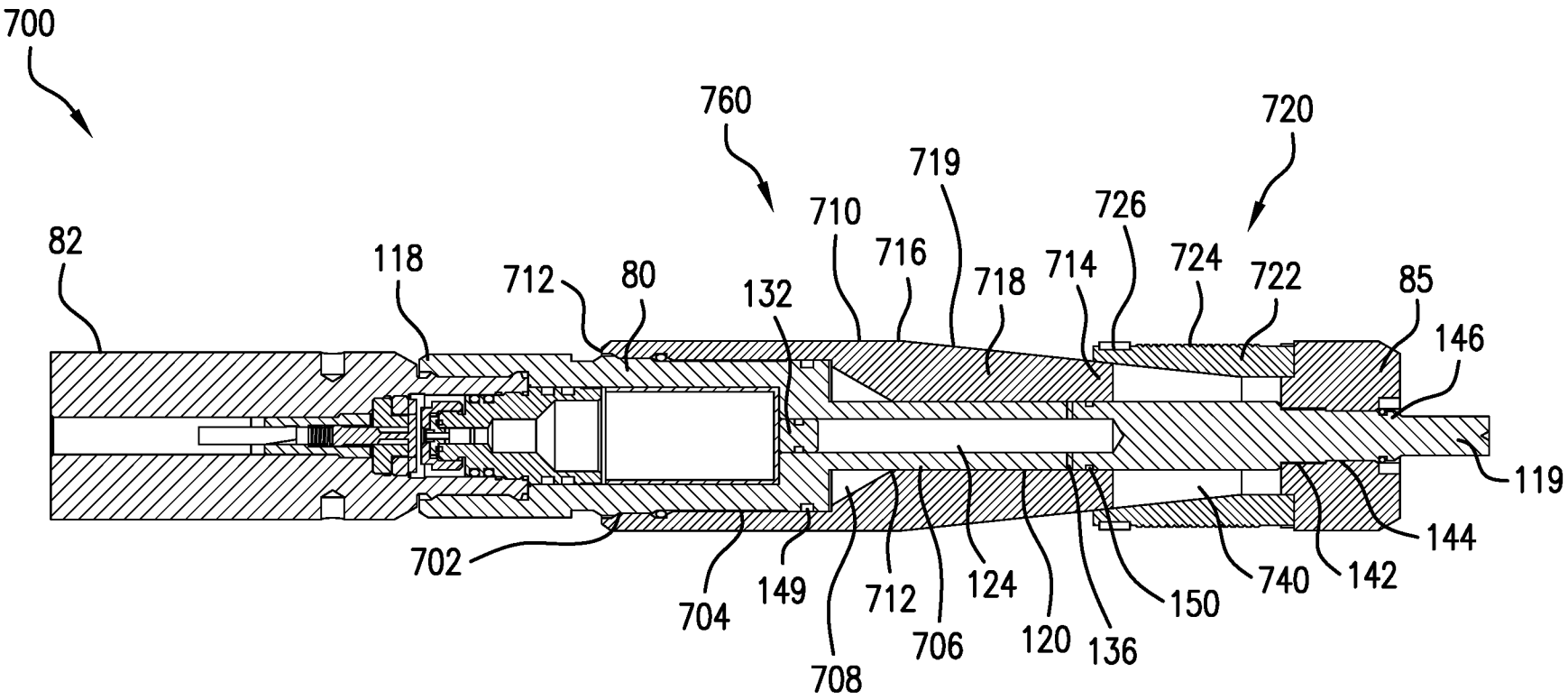
FIG. 7 shows an integrated frac plug system in an alternate embodiment.

FIG. 7 shows an integrated frac plug system 700 in an alternate embodiment. The integrated frac plug system 700 includes a mandrel 80 that extends from a first end portion 118 to a second end portion 119 via an intermediate section 120. The mandrel 80 extends through setting assembly such as a setting cone 760 and supports an actuator head 82 at its first end portion 118. Mandrel 80 also extends through an end cap 85 and its second end portion 119.

The end cap 85 is coupled to an anchor 720. The anchor 720 includes a slip 722 expandable in a radial direction. The slip 722 is capable of deforming or expanding radially to engage with the casing tubular 40 as a unitary piece, i.e, without breaking or rupturing, when a radial force is applied to it. The slip 722 includes a rough outer diameter surface 724 for gripping a casing tubular 40 and a seal 726 for forming a seal between the slip 722 and the casing tubular 40. The seal 726 is disposed on the outer diameter of the slip 722 and extends circumferentially around the outer diameter of slip 722. End cap 85 holds slip 722 in place along the mandrel 80 while setting cone 760 moves against the slip 722 to radially expand the slip into sealing contact with annular wall 38 of casing tubular 40.

Setting cone 760 includes a body 710 including a first end portion 712, a second end portion 714, and an intermediate portion 716. A portion of body 710 includes a taper portion 718. In an embodiment, tapered portion 718 defines a frusto-conical surface 719 that tapers, or reduces in diameter, in the direction of the second end 714. A passage 708 extends through body 710. Passage 708 includes a first portion 704 having a first diameter and a second portion 706 having a second diameter that is smaller than the first diameter. Mandrel 80 extends through passage 708.

The mandrel 80 includes an inner bore forming an activation chamber 124 having a movable piston 132 therein. A fluid 134, such as hydraulic fluid, aqueous solution, gas, etc., is disposed in the activation chamber 124. Ignition of a charge generates or increases a pressure as gas in the activation chamber 124 moves the piston 132 within the activation chamber 124, and one or more openings 136 allow passage of fluid 134 from activation chamber 124 to passage 708 upon movement of piston 132 to move the setting cone 760 along mandrel 80 toward end cap 85.

Second end portion 119 extends through a central opening 740 in anchor 720 and a passage portion 142 in end cap 85. In one embodiment, second end portion 119 can be connected to end cap 85 through frangible threads 144. Second end portion 119 can include a stop member or travel limiter 146 that prevents end cap 85 from pre-maturely disengaging from mandrel 80 during, for example, run in. Travel limiter 146 can take the form of an O-ring.

A thread 712 provides a connection between setting cone 760 and mandrel 80 during a run-in operation. A first seal 149 is arranged between first end portion 118 and first portion 704 of passage 708. A second seal 150 extends about intermediate section 120 axially outwardly of openings 136 toward second end portion 119.

In one embodiment, the integrated frac plug system 700 is run into wellbore 34 to a desired position. Once in position, a power charge is ignited as disclosed herein to act on piston 132, driving fluid 134 through openings 136. Fluid 134 flows toward first end portion 118, causing threads 712 to shear and moving setting cone 760 against the anchor 720, thereby expanding the slip 722 and seal 726 into sealing engagement with the casing tubular. After anchor 720 is set, mandrel 80 can be pulled uphole to disengage shear frangible threads 144 between mandrel 80 and end cap 85 to separate end cap 85 from mandrel 80, thereby leaving setting cone 760 and anchor 720 in place within the wellbore.

Figure 8:
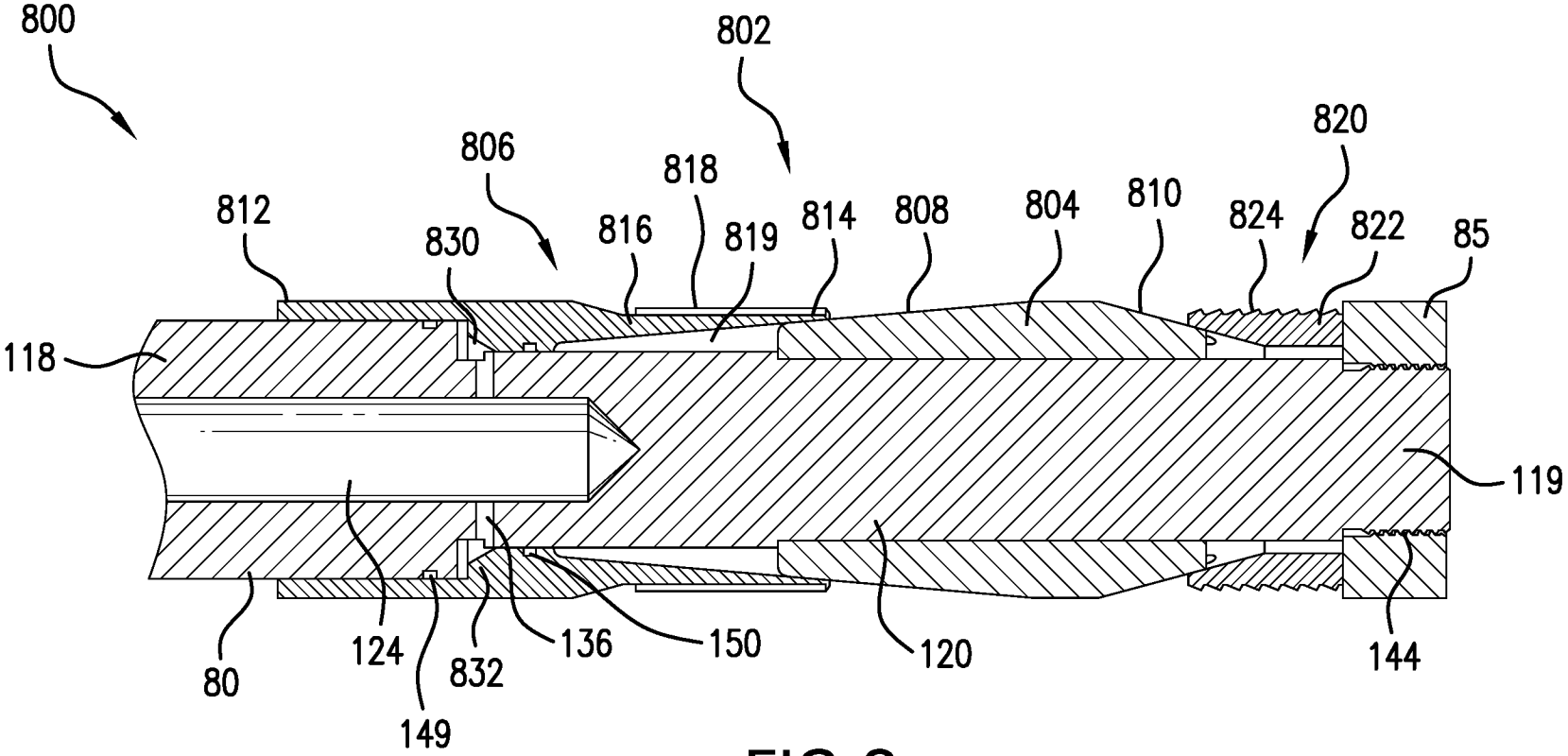
FIG. 8 shows an integrated frac plug system in an alternate embodiment.

FIG. 8 shows an integrated frac plug system 800 in an alternate embodiment. The integrated frac plug system 800 includes a mandrel 80 that extends from a first portion end 118 to a second end portion 119 via an intermediate section 120. The mandrel 80 extends through setting assembly 802 and end cap 85. The end cap 85 is coupled to the mandrel 80 and its second end portion 119 via frangible threads 144.

An anchor 820 circumferentially surrounds the mandrel 80 at the second end 199 and is coupled to end cap 85. The anchor 820 includes an slip 822 expandable in a radial direction. The slip 822 includes a rough outer diameter surface 824 for gripping a casing tubular 40. Setting assembly 802 moves along mandrel 80 toward end cap 85 to expand slip 65 into engagement with annular wall 38. In another embodiment, the slip 822 can be a breakable slip that selectively breaks into subcomponents when it is expanded radially.

Setting assembly 802 includes a setting member 804 and a collar 806. The setting member 804 is disposed between the collar 806 and the anchor 820. The setting member 804 includes a first frusto-conical surface 808 that tapers in the direction of the collar 806 and a second frusto-conical surface 810 that tapers in the direction of the anchor 820. The collar 806 extends from a ball seat end 812 to a setting end 814. A thin wall section 816 of the collar 806 is flexible to expand radially outward and includes a seal 818 on its outer diameter surface. An inwardly facing surface 819 of the thin wall section 816 tapers to form a funnel having an opening at the setting end 814. The slope of the surface 818 can be made to match the slope of the first frusto-conical surface 808 of the setting member 804 in order to facilitate receiving the first frusto-conical surface 808 at the collar 806.

The mandrel 80 includes an inner bore forming an activation chamber 124 having a movable piston and fluid therein. Ignition of a charge moves the piston within the activation chamber to force the fluid through ports 136 in a chamber 830 formed between collar 806 and mandrel 80 by seal 149 and 150, thereby forcing the collar toward the second end portion 119. Collar 806 moves setting member 804 against the anchor 820, forcing expandable slip 822 to expand radially to engage the casing tubular. The collar 806 the moves against the setting member 805 to expand radially outward to sealably engage the casing tubular via seal 818.

The mandrel 80 can then be pulled uphole to shear the frangible threads 144, thereby leaving the anchor 802, setting member 804 and collar 806 in place downhole. The collar 806 includes a ball seat 832 that can be used to receive a ball of plug dropped downhole once the mandrel 80 is removed.

Figure 9:
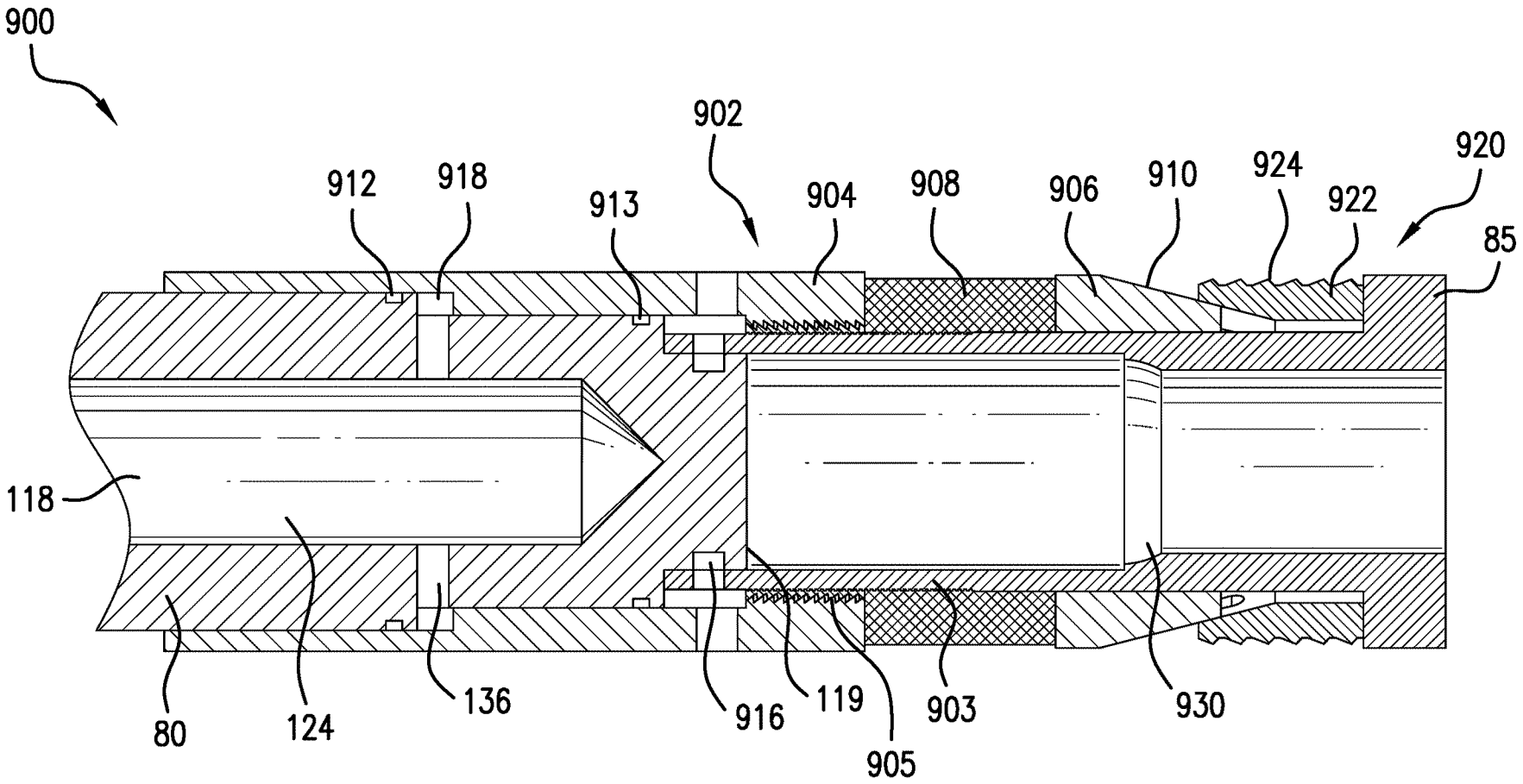
FIG. 9 shows an integrated frac plug system in an alternate embodiment.

FIG. 9 shows an integrated frac plug system 900 in an alternate embodiment. The integrated frac plug system 900 includes a setting mandrel 80 coupled to a plug mandrel 903. The setting mandrel 80 extends from a first end portion 118 to a second end portion 119. The plug mandrel 903 is coupled to the setting mandrel 80 at the second end portion 119 via a frangible member 916. The plug mandrel 903 has a flange section distal from the frangible member 916 to form an end cap 85.

The setting assembly 902 is disposed along an outer diameter of the setting mandrel 80 and plug mandrel 903. The setting assembly 902 includes a first setting member 904, a second setting member 906 and an seal member 908 located axially between the first setting member 904 and second setting member 906 and coupling the first setting member 904 to the second setting member 906. The first setting member 904 is coupled to the mandrel 903 via a one-way locking device such as body lock ring 905 and coupled with mandrel 80 in a position that allows a chamber 918 between the first setting member 904 and the mandrel 80 by seal 912 and 913. The second setting member 906 includes a frusto-conical surface 910 that tapers in the direction of the anchor 920. Upon activation (via ignition of a charge), a gas pressure pushes the first setting member 904 toward end cap 85 to deploy anchor 920 via the second setting member 906, and to compress seal member 908 against second setting member 906 to thereby seal off the inner diameter of the casing tubular 40. The seal member 908 is made of an elastic or deformable material. The anchor 920 includes a slip 922 having a rough outer diameter surface 924 for gripping a casing tubular 40. The slip 922 can either be an expandable slip or a breakable slip.

Body lock ring 905 locks the first setting member 904 in place with respect to the plug mandrel 903 once the anchor has been set and the inner diameter of casing tubular 40 has been sealed off. The setting mandrel 80 can then be pulled to break frangible member 916, thereby separating the setting mandrel 80 from the plug mandrel 903.

Figure 10:
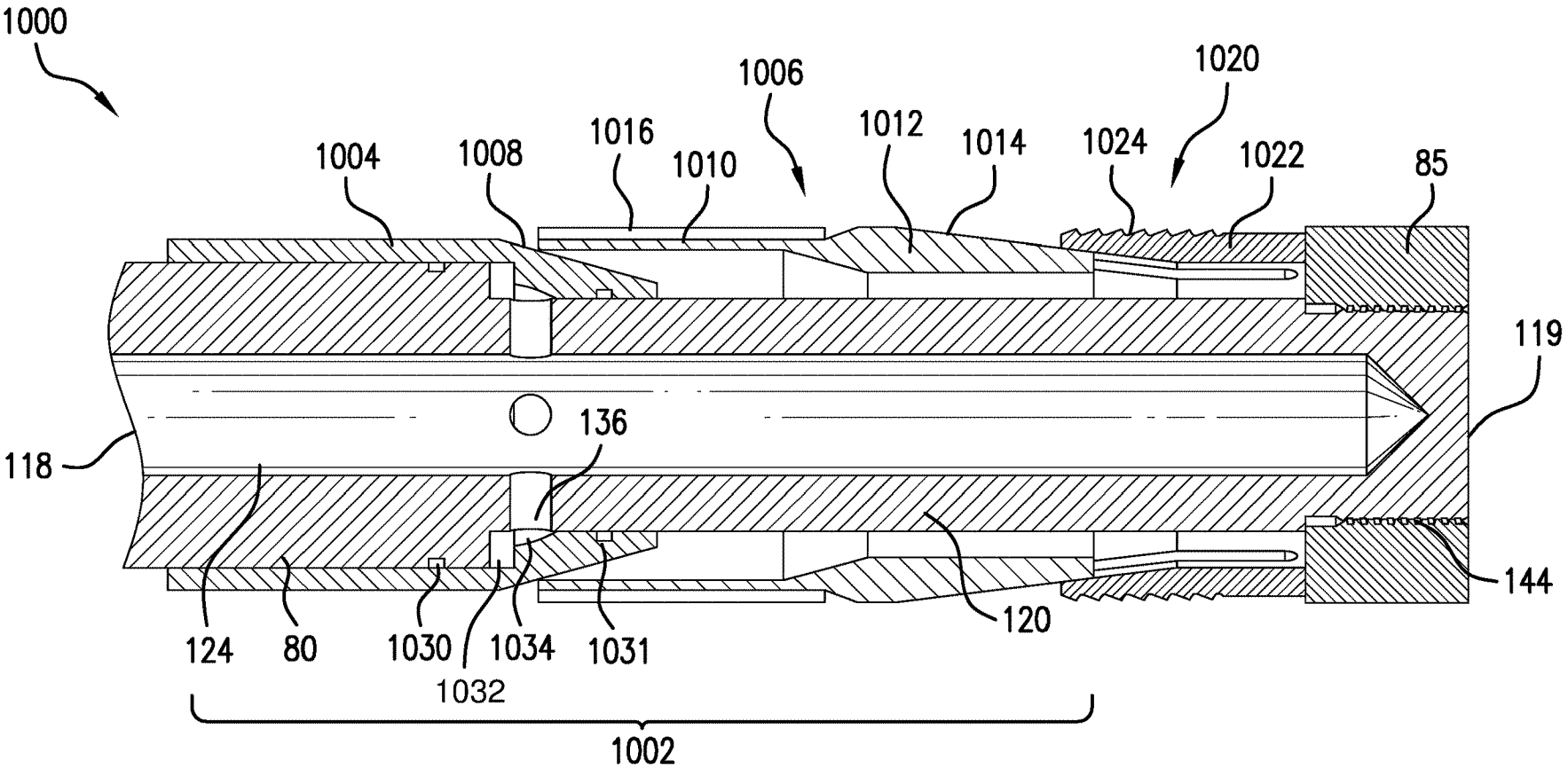
FIG. 10 shows an integrated frac plug system in an alternate embodiment.

FIG. 10 shows an integrated frac plug system 1000 in an alternate embodiment. The integrated frac plug system 1000 includes a mandrel 80 that extends from a first end portion 118 to a second end portion 119 via an intermediate section 120. The mandrel 80 extends through setting assembly 1002 and end cap 85. The end cap 85 is coupled to the mandrel 80 at its second end portion 119 via frangible threads 144. The mandrel 80 further includes an activation chamber 124 therein and a port 136.

An anchor 1020 circumferentially surrounds the mandrel 80 at the second end portion 119 and is coupled to end cap 85. The anchor 1020 includes an slip 1022 expandable in a radial direction. The slip 1022 includes a rough outer diameter surface 1024 for gripping a casing tubular 40. Setting assembly 1002 moves along mandrel 80 toward end cap 85 to expand slip 1022 into engagement with annular wall 38. In another embodiment, the slip 1022 can be a breakable slip that selectively breaks into subcomponents when it is expanded radially The setting assembly 1002 includes a first setting cone 1004 and a second setting cone 1006 disposed between the first setting cone 1004 and the anchor 1020. The first setting cone 1004 includes a frusto-conical surface 1008 that tapers in the direction of the anchor 1020. The first setting cone 1004 is coupled to the mandrel 80 that allows a chamber 1032 between the first setting member 1004 and the mandrel 80 by seal 1030 and 1031 that forms a chamber 1032 for receiving a fluid from activation chamber 124 via port 136.

The second setting cone 1006 includes a thin wall section 1010 movable against the first setting cone 1004 and a cone section 1012 having a frusto-conical outer surface 1014 that interacts with the anchor 1020. The thin wall section 1010 includes a seal 1016 on its outer diameter surface.

Upon ignition of a charge, fluid from the activation chamber 124 is forced into chamber 1032 via port 136. The fluid pushes the first setting cone 1004 to move toward the second end portion 119, thereby causing the second setting cone 1006 to move against the anchor 1020. Frusto-conical surface 1014 then causes the slip 1022 to expand against a wall of the casing tubular. When the second setting cone 1006 is no longer able to move toward the second end. The first setting cone 1004 moves against the second setting one 1006 to expand the thin wall section 1010 into sealing engagement with the casing tubular via seal 1016. The mandrel 80 is then pulled uphole, shearing frangible threads 144, thereby leaving the first setting cone 1004, second setting cone 1006 and anchor 1020 downhole within the casing tubular. The first setting cone 1004 includes a ball seat 1034 on its inner diameter surface for receiving a plug or ball that can be subsequently dropped downhole.

Set forth below are some embodiments of the foregoing disclosure:

Embodiment 1

A method of securing a frac plug system in a wellbore. The method includes disposing the frac plug system in the wellbore, the frac plug system including: a mandrel extending from a first end to a second end, a setting assembly at a first end of the mandrel, wherein the setting assembly is movable along the mandrel, and an anchor at a second end of the mandrel, the anchor expandable to engage the wellbore; and generating a pressure in a gas of the frac plug system to move the setting assembly from the first end to the second end to expand the anchor at the second end of the mandrel.

Embodiment 2

The method of any prior embodiment, wherein the anchor is expandable to engage the wellbore as a unitary piece, further comprising moving the setting assembly against the slip to expand the anchor radially.

Embodiment 3

The method of any prior embodiment, further comprising a pressure chamber in the setting assembly and an activation chamber in the mandrel having the gas and in fluid communication with the pressure chamber via an opening in the mandrel, wherein generating the pressure in the gas moves the setting assembly from the first end of the mandrel to the second end of the mandrel.

Embodiment 4

The method of any prior embodiment, wherein the setting assembly further comprises a frusto-conical setting cone movable from the first end to the second end to expand the anchor.

Embodiment 5

The method of any prior embodiment, wherein the setting assembly further comprises a collar and a setting member having first frusto-conical surface receptive to the collar and a second frusto-conical surface receptive to the anchor.

Embodiment 6

The method of any prior embodiment, wherein the setting assembly further comprises first setting member, a second setting member having a frusto-conical surface and a member that couples the first setting member to the second setting member.

Embodiment 7

The method of any prior embodiment, wherein the setting assembly further comprises a first setting cone and a second setting cone between the first setting cone and the anchor, wherein the first setting cone moves against the second setting cone to expand the anchor.

Embodiment 8

A downhole tool. The downhole tool includes a mandrel extending from a first end to a second end, a setting assembly on the first end of the mandrel, the setting assembly movable along the mandrel, an anchor at the second end of the mandrel, the anchor expandable to engage the wellbore, and a gas for moving the setting assembly along the mandrel to expand the anchor at the second end of the mandrel.

Embodiment 9

The downhole tool of any prior embodiment, wherein the anchor is radially expandable to engage the wellbore as a unitary piece.

Embodiment 10

The downhole tool of any prior embodiment, further comprising a pressure chamber in the setting assembly and an activation chamber in the mandrel having the gas and in fluid communication with the pressure chamber via an opening in the mandrel, wherein a pressure generated in the gas moves the setting assembly.

Embodiment 11

The downhole tool of any prior embodiment, wherein the setting assembly further comprises a setting cone having a frusto-conical surface that is moved against the anchor.

Embodiment 12

The downhole tool of any prior embodiment, wherein the setting assembly further comprises a collar and a setting member having first frusto-conical surface receptive to the collar and a second frusto-conical surface receptive to the anchor.

Embodiment 13

The downhole tool of any prior embodiment, wherein the setting assembly further comprises first setting member, a second setting member having a frusto-conical surface and a member that couples the first setting member to the second setting member.

Embodiment 14

The downhole tool of any prior embodiment, wherein the setting assembly further comprises a first setting cone and a second setting cone between the first setting cone and the anchor, wherein the first setting cone moves against the second setting cone to expand the anchor.

Embodiment 15

A frac plug system. The frac plug system includes a mandrel extending from a first end to a second end, a setting assembly on the first end of the mandrel, an anchor at the second end of the mandrel, the anchor expandable to engage the wellbore, and a gas for moving the setting assembly along the mandrel to expand the anchor at the second end of the mandrel.

Embodiment 16

The frac plug system of any prior embodiment, wherein the anchor is radially expandable to engage the wellbore as a unitary piece.

Embodiment 17

The frac plug system of any prior embodiment, further comprising a pressure chamber in the setting assembly and an activation chamber in the mandrel having the gas and in fluid communication with the pressure chamber via an opening in the mandrel, wherein a pressure generated in the gas moves the setting assembly.

Embodiment 18

The frac plug system of any prior embodiment, wherein the setting assembly further comprises a setting cone having a frusto-conical surface that is moved against the anchor.

Embodiment 19

The frac plug system of any prior embodiment, wherein the setting assembly further comprises a collar and a setting member having first frusto-conical surface receptive to the collar and a second frusto-conical surface receptive to the anchor.

Embodiment 20

The frac plug system of any prior embodiment, wherein the setting assembly further comprises first setting member, a second setting member having a frusto-conical surface and a member that couples the first setting member to the second setting member.

Embodiment 21

The frac plug system of any prior embodiment, wherein the setting assembly further comprises a first setting cone and a second setting cone between the first setting cone and the anchor, wherein the first setting cone moves against the second setting cone to expand the anchor.

The use of the terms “a” and “an” and “the” and similar referents in the context of describing the invention (especially in the context of the following claims) are to be construed to cover both the singular and the plural, unless otherwise indicated herein or clearly contradicted by context. Further, it should be noted that the terms “first,” “second,” and the like herein do not denote any order, quantity, or importance, but rather are used to distinguish one element from another. The modifier “about” used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of securing a frac plug system in a wellbore, comprising:

disposing the frac plug system in the wellbore, the frac plug system including:

a mandrel extending from a first end to a second end, the mandrel having an activation chamber including a piston separating a fluid from a power charge;

a setting assembly at the first end of the mandrel and forming a pressure chamber between the setting assembly and the mandrel, wherein the setting assembly is movable along the mandrel;

an anchor at the second end of the mandrel, the anchor expandable to engage the wellbore; and activating the power charge to act on the piston to drive the fluid from the activation chamber into the pressure chamber to move the setting assembly from the first end to the second end to expand the anchor at the second end of the mandrel.

2. The method of claim 1, wherein the anchor is expandable to engage the wellbore as a unitary piece, further comprising moving the setting assembly against a slip to expand the anchor radially.

3. The method of claim 1, wherein the mandrel further comprises a port between the fluid of the activation chamber and the pressure chamber, further comprising driving the fluid through the port into the pressure chamber via the piston.

4. The method of claim 1, wherein the setting assembly further comprises a frusto-conical setting cone movable from the first end to the second end to expand the anchor.

5. The method of claim 1, wherein the setting assembly further comprises a collar and a setting member having first frusto-conical surface receptive to the collar and a second frusto-conical surface receptive to the anchor.

6. The method of claim 1, wherein the setting assembly further comprises first setting member, a second setting member having a frusto-conical surface and a member that couples the first setting member to the second setting member.

7. The method of claim 1, wherein the setting assembly further comprises a first setting cone and a second setting cone between the first setting cone and the anchor, wherein the first setting cone moves against the second setting cone to expand the anchor.

8. A downhole tool, comprising:

a mandrel extending from a first end to a second end;

a setting assembly on the first end of the mandrel and forming a pressure chamber between the setting assembly and the mandrel, the setting assembly movable along the mandrel;

an anchor at the second end of the mandrel, the anchor expandable to engage a wellbore; and an activation chamber in the mandrel, the activating chamber including a piston separating a fluid from a power charge activatable to act on the piston to drive the fluid from the activation chamber into the pressure chamber, thereby moving the setting assembly from the first end to the second end to expand the anchor at the second end of the mandrel.

9. The downhole tool of claim 8, wherein the anchor is radially expandable to engage the wellbore as a unitary piece.

10. The downhole tool of claim 8, further comprising a port in the mandrel between the fluid of the activation chamber and the pressure chamber.

11. The downhole tool of claim 8, wherein the setting assembly further comprises a setting cone having a frusto-conical surface that is moved against the anchor.

12. The downhole tool of claim 8, wherein the setting assembly further comprises a collar and a setting member having first frusto-conical surface receptive to the collar and a second frusto-conical surface receptive to the anchor.

13. The downhole tool of claim 8, wherein the setting assembly further comprises first setting member, a second setting member having a frusto-conical surface and a member that couples the first setting member to the second setting member.

14. The downhole tool of claim 8, wherein the setting assembly further comprises a first setting cone and a second setting cone between the first setting cone and the anchor, wherein the first setting cone moves against the second setting cone to expand the anchor.

15. A frac plug system, comprising:

a mandrel extending from a first end to a second end;

a setting assembly on the first end of the mandrel and forming a pressure chamber between the setting assembly and the mandrel;

an anchor at the second end of the mandrel, the anchor expandable to engage a wellbore; and an activation chamber in the mandrel, the activating chamber including a piston separating a fluid from a power charge activatable to act on the piston to drive the fluid from the activation chamber into the pressure chamber, thereby moving the setting assembly from the first end to the second end to expand the anchor at the second end of the mandrel.

16. The frac plug system of claim 15, wherein the anchor is radially expandable to engage the wellbore as a unitary piece.

17. The frac plug system of claim 15, further comprising a port in the mandrel between the fluid of the activation chamber and the pressure chamber.

18. The frac plug system of claim 15, wherein the setting assembly further comprises a setting cone having a frusto-conical surface that is moved against the anchor.

19. The frac plug system of claim 15, wherein the setting assembly further comprises a collar and a setting member having first frusto-conical surface receptive to the collar and a second frusto-conical surface receptive to the anchor.

20. The frac plug system of claim 15, wherein the setting assembly further comprises first setting member, a second setting member having a frusto-conical surface and a member that couples the first setting member to the second setting member.

21. The frac plug system of claim 15, wherein the setting assembly further comprises a first setting cone and a second setting cone between the first setting cone and the anchor, wherein the first setting cone moves against the second setting cone to expand the anchor.

* * * * *